United States Patent [19]

Leclerc et al.

[11] Patent Number: 4,936,895

[45] Date of Patent: Jun. 26, 1990

[54] RELEASABLE LOCK WITH A ROTABLE STATOR

[75] Inventors: Patrick Leclerc, Sartrouville; Louis Canard, Rueil-Malmaison, both of France

[73] Assignee: Valeo Neiman, Croissy-sur-Seine, France

[21] Appl. No.: 467,564

[22] Filed: Jan. 19, 1990

[30] Foreign Application Priority Data

Jan. 30, 1989 [FR] France ..... 89 01101

[51] Int. Cl.[5] ..... E05B 17/04

[52] U.S. Cl. ..... 70/380; 70/422

[58] Field of Search ..... 70/380, 379 R, 379 A, 70/422, 416

[56] References Cited

U.S. PATENT DOCUMENTS 1,876,803 9/1932 Von Mehren ..... 70/380

4,347,421 9/1982 Borgman ..... 70/380

FOREIGN PATENT DOCUMENTS 0151081 8/1985 European Pat. Off. .

*Primary Examiner*—Robert L. Wolfe

*Attorney, Agent, or Firm*—Dennison, Meserole, Pollack & Scheiner

[57] ABSTRACT

In a releasable lock of the kind in which a rotor is controlled by a key suitably profiled to release a stator, the stator comprises a barrel mounted rotatably in a body of the lock and indexed resiliently with respect to the latter, with the rotor controlling an actuating finger for a lock mechanism. The actuating finger is fixed to a first lever which is pivoted on an eccentric first axis fixed to the barrel, the actuating finger also being coaxial to both the rotor and the barrel in a rest position of the lock, and extending through a second lever for actuating the lock mechanism. This second lever is pivoted about an eccentric second axis fixed to the lock body, and the rotor includes a rotor pin for driving the first lever.

5 Claims, 1 Drawing Sheet

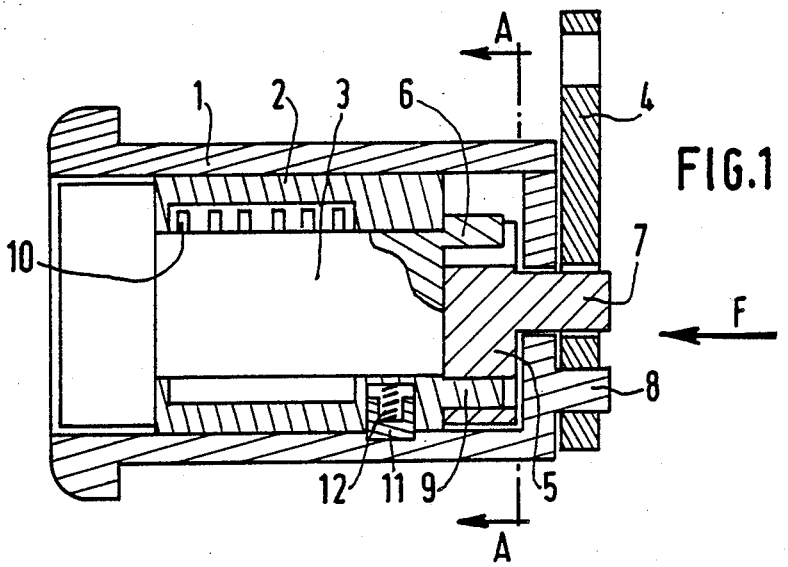
FIG.1
FIG.2
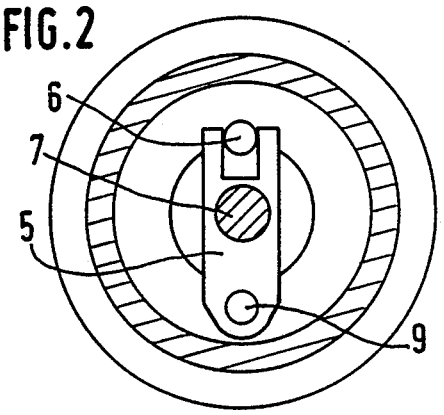
FIG.3
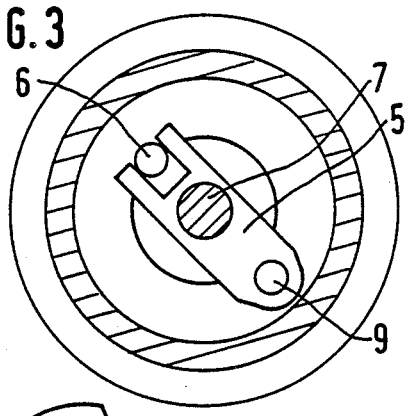
FIG.4
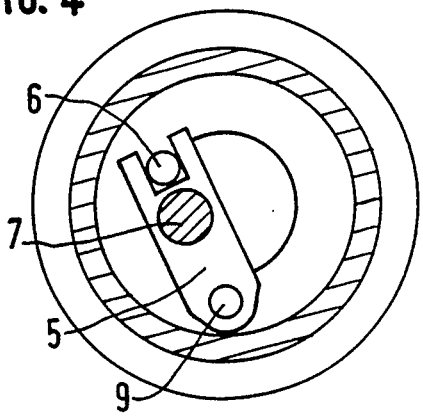
FIG.5
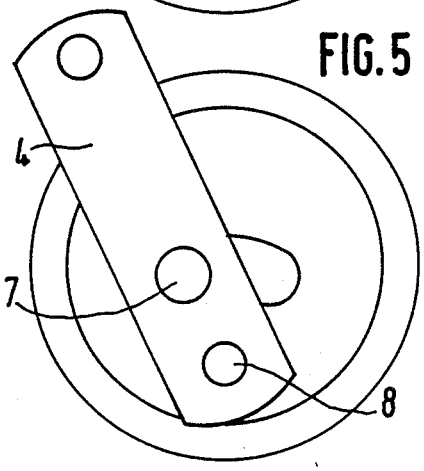

RELEASABLE LOCK WITH A ROTABLE STATOR

FIELD OF THE INVENTION

This invention is concerned with a releasable lock of the type comprising a rotor controlled by a suitably profiled key for releasing a stator of the lock, the stator comprising a barrel which is rotatably mounted in a body of the lock and which is resiliently indexed with respect to the said body, with the rotor being arranged to control an actuating finger for a lock mechanism, the actuating finger being maintained coaxial with the rotor and with the barrel in the event of the rotor and barrel being rotated simultaneously, in such a way that the lock mechanism is then not operated.

BACKGROUND OF THE INVENTION

In locks of known types, the actuating finger is made coaxial with the barrel and therefore with the rotor during rotation of the barrel, or, alternatively, it is displaced in translational movement in order to release the lock mechanism.

Even though these known locks do offer good security against attempts at unathrorized entry by manipulation of the locking elements between the rotor and the stator (for example pistons or pallets), they are nevertheless of complicated and cumbersome construction, because of the movements which the driving finger has to carry out in order to free the lock mechanism.

SUMMARY OF THE INVENTION

An object of the present invention is therefore to provide a lock of the kind described above, which will be of simpler and less cumbersome construction.

To this end, a lock according to the invention is characterized aws follows. First, the actuating finger is fixed with respect to a first lever, which is pivoted about an eccentric first axis that is fixed with respect to the barrel. The actuating finger is coaxial with both the rotor and the barrel in the rest position of the lock, and is arranged to extend through a second lever for controlling the lock. The second lever is, in turn, pivoted about an eccentric second axis which is fixed with respect to the lock body. Finally, the rotor includes a rotor pin for driving the first lever.

In normal operation, when the correct key is introduced into the rotro, the latter pivots with respect to the barrel, which, due to its indexation, remains fixed with respect to the lock body. The first lever is driven in rotation about the first axis by means of the rotor pin, while the actuating finger, being fixed with respect to the first lever, drives the second lever in rotation about the second axis. This operates the lock mechanism.

By contrast, if an attempt at fraudulent entry is made, the barrel and the rotor move together in pivotal rotation, so that the first lever now pivots with the barrel. The actuating thus remains coaxial with the barrel and the rotor, and cannot then actuate the second lever.

The invention will be clearly understood from a reading of the following description, which is given by way of example and with reference to the accompanying drawings.

BRIEF DESCRIPTION OF THE DRAWINGS

FIG. 1 is a diagrammatic view in axial cross section, of a lock in one embodiment according to the invention.

FIG. 2 is a view in cross section, taken on the line A—A in FIG. 1, showing the lock in a rest position.

FIG. 3 is similar to FIG. 2, but shows the lock after it has been rotated using a false key or other instrument in an attempt at fraudulent entry.

FIG. 4 is similar to FIGS. 2 and 3, and shows the lock after being rotated using a key profiled to fit the lock.

FIG. 5 is an end view, as seen in the direction of the arrow F in FIG. 1, showing the lock in the same position as in FIG. 4.

DESCRIPTION OF PREFERRED EMBODIMENT OF THE INVENTION

The lock includes a body 1 in which a barrel or intermediate stator 2 is rotatable. A rotor 3 is mounted for coaxial pivoting movement in the barrel 2. A tilting or swinging lever 4 controls the lock mechanism itself (not shown). A lever 5 is driven by means of a rotor pin 6, which is part of the rotor 3. The lever 5 carries an actuating finger 7 which extends through an opening in the lever 4. The lever 4 is mounted for pivoting movement about an eccentric axis defined by a pivot pin 8 which is fixed with respect to the body 1, while the lever 5 is mounted for pivoting movement about an eccentric axis defined by another pivot pin 9, which is fixed with respect to the barrel 2.

A series of locking pallets 10 are mounted so as to project out of the rotor 3, and to lock the rotor 3 and barrel 2 together in the absence of the key, or if an incorrect key is used, this being achieved in the conventional way by means of notches formed in the pallets 10. When the correct key is introduced, the pallets 10 are retracted into the interior of the rotor 3, which is thus released from the barrel 2.

In the rest position seen in FIGS. 1 and 2, the actuating finger 7 is coaxial with the rotor 3 and also with the barrel 2, which is indexed with respect to the body 1 by means of an indexer 11 penetrating into an opening formed in the body 1, under the action of a return spring 12.

When a false key, or a tool other than the correct key, is introduced into the rotor 3, the latter drives the barrel 2 (FIG. 3) in rotation by means of the pallets 10, which have not been retracted into the rotor 3. The indexer 11 is compressed towards the interior of the barrel 2 against the action of the spring 12. Rotation of the barrel 2 against causes the lever 5 to be moved correspondingly, by means of the pivot pin 9 and the rotor pin 6, which is not released for relative movement with respect to the lever 5. The actuating finger 7 of the lever 5 pivots with the subassembly comprising the barrel 2, rotor 3 and lever 5, so that it remains coaxial to both the rotor 3 and the barrel 2. For this reason, the lever 4 is not itself operated, and the lock mechanism is therefore not actuated.

By contrast, after the correct key has been introduced and rotated (FIGS. 4 and 5), the barrel 2 remains fixed with respect to the body 1, through the indexer 11, because the rotor 3 has been released from the barrel 2 by the retraction of the pallets 10. The rotor pin 6 therefore drives the lever 5 in rotation about the axis 9, so that the lever 5 forces the actuating finger 7 to move in an arc about this axis, carrying with it the lever 4, which pivots about the axis 8 and actuates the lock mechanism.

If it should be desired that the actuation of the lever 4 be retarded by a predetermined angle of rotation of the rotor 3, it is possible to provide a corresponding angular clearance between the rotor pin 6 and the lever 5, or between the finger 7 and the lever 4.

As is the case in the example shown in the drawings, the axes 9 and 8 are arranged so as to be in axial alignment with each other in the rest position. If they are offset with respect to each other, then the opening in the lever 4 through which the actuating finger 7 extends, must be radially elongated.

What is claimed is:

1. A releasable lock comprising a stator including a barrel, a body mounting the said rotatably therein, resilient means in the body indexing the barrel resiliently with respect to the body, and a rotor mounted in the body for control by a key profiled so as to release the stator, the barrel having fixed thereto means defining an eccentric second axis, the lock further comprising a first lever pivoted on the first asix, a second lever pivoted on the second axis for actuating a lock mechanism, and an actuating finger carried by the first lever and extending through the second lever for displacing the latter so as to actuate the said lock mechanism, the rotor including a rotor pin for displacing the first lever in pivotal movement, whereby the actuating finger being coaxial with both the rotor and the barrel when the lock is in a rest position, it is maintained coaxial with the rotor and the barrel when the rotor and the barrel are rotated simultaneously, whereby not to operate the said lock mechanism.

2. A lock according to claim 1, wherein the said first and second axes are so located as to be axially aligned with each other in the said rest position.

3. A lock according to claim 1, wherein the said first and second axes are offset radially in the rest position and the second lever is formed with a radially elongated opening, with the actuating finger extending through the elongated opening.

4. A lock according to any one of claims 1 to 3, wherein the said rotor pin and the first lever are so located as to define an angular clearance between them.

5. A lock according to any one of claims 1 to 3, wherein the actuating finger and the second lever are so located as to define an angular clearance between them.

* * * * *